US009966655B2

(12) United States Patent
Li et al.

(10) Patent No.: US 9,966,655 B2
(45) Date of Patent: May 8, 2018

(54) ANTENNA STRUCTURE AND MOBILE TERMINAL DEVICE

(71) Applicant: Huawei Device Co., Ltd., Shenzhen (CN)

(72) Inventors: Yuanpeng Li, Beijing (CN); Yafang Yu, Beijing (CN); Meng Hou, Shanghai (CN)

(73) Assignee: Huawei Device (Dongguan) Co., Ltd., Dongguan (CN)

( * ) Notice: Subject to any disclaimer, the term of this patent is extended or adjusted under 35 U.S.C. 154(b) by 62 days.

(21) Appl. No.: 15/173,086

(22) Filed: Jun. 3, 2016

(65) Prior Publication Data

US 2016/0285153 A1 Sep. 29, 2016

Related U.S. Application Data

(63) Continuation of application No. PCT/CN2014/092945, filed on Dec. 3, 2014.

(30) Foreign Application Priority Data

Dec. 6, 2013 (CN) ..... 2013 1 0656510

(51) Int. Cl.
*H01Q 1/50* (2006.01)
*H01Q 1/24* (2006.01)
(Continued)

(52) U.S. Cl.
CPC ..... *H01Q 1/243* (2013.01); *H01Q 1/50* (2013.01); *H01Q 5/385* (2015.01); *H01Q 7/00* (2013.01); *H01Q 9/0421* (2013.01)

(58) Field of Classification Search
CPC ..... H01Q 1/243; H01Q 5/385; H01Q 1/50; H01Q 7/00; H01Q 9/0421
(Continued)

(56) References Cited

U.S. PATENT DOCUMENTS 7,046,196 B1 5/2006 Langley et al.
2002/0135521 A1 9/2002 Moore
(Continued)

FOREIGN PATENT DOCUMENTS

CN 102593578 A 7/2012
CN 103633426 A 3/2014

OTHER PUBLICATIONS

Rohith K. Raj et al., "A New Compact Microstrip-Fed Dual-Band Coplanar Antenna for WLAN Applications", IEEE Transactions on Antennas and Propagation, vol. 54, No. 12, Dec. 2006, p. 3755-3762.

*Primary Examiner* — Andrea Lindgren Baltzell

(57) ABSTRACT

The present invention discloses an antenna structure and ensures an all-metal housing feature of the mobile terminal device. The antenna structure includes a housing and a feed plate, where the housing includes a main housing, a first floating object, a second floating object, and an antenna radiator; and the first floating object, the second floating object, and the antenna radiator are separated from the main housing by a first slot; there is a second slot between the first floating object and one side of the antenna radiator, and a third slot between the second floating object and the other side of the antenna radiator; the main housing, the first floating object, the second floating object, and the antenna radiator are connected as a whole by an insulator; and the feed plate is disposed opposite to the main housing, the first floating object, and the antenna radiator at an interval.

13 Claims, 3 Drawing Sheets

(51) Int. Cl.
*H01Q 7/00* (2006.01)
*H01Q 9/04* (2006.01)
*H01Q 5/385* (2015.01)

(58) Field of Classification Search
USPC ..... 343/702
See application file for complete search history.

(56) References Cited

U.S. PATENT DOCUMENTS

| | | | | |
|---|---|---|---|---|
| 2004/0214620 | A1 | 10/2004 | Kozakai et al. | |
| 2007/0164913 | A1 | 7/2007 | Sakamoto et al. | |
| 2009/0189815 | A1 | 7/2009 | Hotta et al. | |
| 2012/0019421 | A1 | 1/2012 | Lai et al. | |
| 2013/0194139 | A1* | 8/2013 | Nickel | H01Q 5/328 343/703 |
| 2013/0249741 | A1 | 9/2013 | Chen et al. | |

* cited by examiner

| Frequency | FS | | BHHL | | Left head-hand reduced amplitude | BHHR | | Right head-hand reduced amplitude |
|---|---|---|---|---|---|---|---|---|
| 830 | -4.9 | 32.7 | -10.1 | 9.8 | *-5.2* | -11.4 | 7.2 | *-6.6* |
| 840 | -4.8 | 33.3 | -10.3 | 9.3 | *-5.5* | -11.7 | 6.7 | *-6.9* |
| 850 | -4.9 | 32.4 | -10.7 | 8.4 | *-5.9* | -12.2 | 6.0 | *-7.3* |
| 860 | -4.9 | 32.3 | -11.1 | 7.8 | *-6.2* | -12.5 | 5.6 | *-7.6* |
| 870 | -4.7 | 34.0 | -11.0 | 7.9 | *-6.3* | -12.5 | 5.6 | *-7.8* |
| 880 | -4.6 | 34.7 | -11.2 | 7.6 | *-6.6* | -12.7 | 5.3 | *-8.2* |
| 890 | -4.8 | 33.0 | -11.5 | 7.0 | *-6.7* | -13.1 | 4.9 | *-8.3* |
| 900 | -5.0 | 31.9 | -11.9 | 6.5 | *-6.9* | -13.4 | 4.5 | *-8.5* |
| 910 | -5.0 | 31.4 | -12.2 | 6.1 | *-7.1* | -13.8 | 4.2 | *-8.7* |
| 920 | -5.1 | 30.7 | -12.3 | 5.9 | *-7.2* | -14.0 | 4.0 | *-8.8* |
| 930 | -5.0 | 31.7 | -12.3 | 5.9 | *-7.3* | -13.9 | 4.0 | *-9.0* |
| 940 | -5.0 | 31.4 | -12.4 | 5.7 | *-7.4* | -14.2 | 3.8 | *-9.1* |
| 950 | -5.3 | 29.6 | -12.8 | 5.2 | *-7.5* | -14.6 | 3.5 | *-9.3* |
| 960 | -5.1 | 30.6 | -12.7 | 5.4 | *-7.5* | -14.5 | 3.6 | *-9.3* |

| Frequency | FS | | BHHL | | Left head-hand reduced amplitude | BHHR | | Right head-hand reduced amplitude |
|---|---|---|---|---|---|---|---|---|
| 1700 | -1.0 | 79.5 | -7.7 | 17.1 | -6.7 | -9.0 | 12.5 | -8.0 |
| 1720 | -1.2 | 75.0 | -7.6 | 17.4 | -6.3 | -9.2 | 11.9 | -8.0 |
| 1740 | -1.7 | 68.1 | -7.5 | 17.6 | -5.9 | -9.5 | 11.3 | -7.8 |
| 1760 | -2.1 | 61.4 | -7.6 | 17.5 | -5.4 | -9.8 | 10.5 | -7.6 |
| 1780 | -2.5 | 56.2 | -7.5 | 17.6 | -5.0 | -10.0 | 10.1 | -7.5 |
| 1800 | -2.7 | 53.5 | -7.4 | 18.1 | -4.7 | -10.0 | 9.9 | -7.3 |
| 1820 | -2.9 | 51.6 | -7.3 | 18.8 | -4.4 | -10.1 | 9.9 | -7.2 |
| 1840 | -3.1 | 49.1 | -7.2 | 18.9 | -4.2 | -10.2 | 9.6 | -7.1 |
| 1860 | -3.4 | 45.4 | -7.5 | 18.0 | -4.0 | -10.5 | 9.0 | -7.0 |
| 1880 | -3.6 | 43.4 | -7.5 | 17.9 | -3.9 | -10.5 | 8.8 | -6.9 |
| 1900 | -3.5 | 44.3 | -7.4 | 18.3 | -3.8 | -10.2 | 9.6 | -6.6 |
| 1920 | -3.3 | 46.8 | -7.3 | 18.6 | -4.0 | -9.9 | 10.2 | -6.6 |
| 1940 | -3.2 | 47.4 | -7.1 | 19.4 | -3.9 | -9.7 | 10.8 | -6.4 |
| 1960 | -3.2 | 48.3 | -7.0 | 20.1 | -3.8 | -9.4 | 11.5 | -6.2 |
| 1980 | -3.2 | 48.2 | -7.1 | 19.7 | -3.9 | -9.3 | 11.7 | -6.2 |
| 2000 | -3.2 | 47.9 | -7.2 | 19.2 | -4.0 | -9.1 | 12.3 | -5.9 |
| 2020 | -3.0 | 50.3 | -7.0 | 20.0 | -4.0 | -8.6 | 13.9 | -5.6 |
| 2040 | -3.0 | 50.6 | -7.1 | 19.4 | -4.2 | -8.4 | 14.6 | -5.4 |
| 2060 | -3.2 | 47.8 | -7.1 | 19.3 | -3.9 | -8.5 | 14.0 | -5.3 |
| 2080 | -3.2 | 47.8 | -6.9 | 20.4 | -3.7 | -8.5 | 14.3 | -5.2 |
| 2100 | -3.2 | 48.2 | -6.9 | 20.3 | -3.7 | -8.6 | 13.9 | -5.4 |
| 2120 | -3.4 | 46.2 | -7.1 | 19.5 | -3.8 | -8.9 | 12.8 | -5.6 |
| 2140 | -3.6 | 43.2 | -7.4 | 18.2 | -3.7 | -9.5 | 11.2 | -5.8 |
| 2160 | -3.7 | 42.7 | -7.5 | 17.9 | -3.8 | -9.9 | 10.2 | -6.2 |
| 2180 | -3.5 | 44.8 | -7.4 | 18.4 | -3.9 | -10.0 | 10.0 | -6.5 |

FIG. 5

| Frequency | FS | | BHHL | | Left head-hand reduced amplitude | BHHR | | Right head-hand reduced amplitude |
|---|---|---|---|---|---|---|---|---|
| 2520 | -1.4 | 72.5 | -5.9 | 25.7 | -4.5 | -8.2 | 15.0 | -6.8 |
| 2540 | -1.6 | 69.3 | -6.2 | 23.7 | -4.7 | -8.5 | 14.1 | -6.9 |
| 2560 | -1.9 | 64.1 | -6.6 | 21.9 | -4.7 | -8.5 | 14.3 | -6.5 |
| 2580 | -2.0 | 63.1 | -6.8 | 20.8 | -4.8 | -8.3 | 14.7 | -6.3 |
| 2600 | -1.5 | 70.8 | -6.5 | 22.2 | -5.0 | -7.7 | 17.1 | -6.2 |
| 2620 | -1.6 | 69.5 | -6.6 | 22.0 | -5.0 | -7.7 | 17.0 | -6.1 |
| 2640 | -1.8 | 66.0 | -6.6 | 21.8 | -4.8 | -7.8 | 16.5 | -6.0 |
| 2660 | -1.9 | 64.2 | -7.0 | 19.8 | -5.1 | -8.2 | 15.1 | -6.3 |
| 2680 | -1.4 | 72.7 | -6.5 | 22.2 | -5.2 | -7.7 | 16.9 | -6.3 |
| 2700 | -0.7 | 86.0 | -5.9 | 25.9 | -5.2 | -7.1 | 19.7 | -6.4 |

FIG. 6

ANTENNA STRUCTURE AND MOBILE TERMINAL DEVICE

CROSS-REFERENCE TO RELATED APPLICATIONS

This application is a continuation of International Application No. PCT/CN2014/092945, filed on Dec. 3, 2014, which claims priority to Chinese Patent Application No. 201310656510.X, filed on Dec. 6, 2013, both of which are hereby incorporated by reference in their entireties.

TECHNICAL FIELD

The present invention belongs to the field of electronic device technologies, and in particular, relates to an antenna structure and a mobile terminal device.

BACKGROUND

With the rapid development of a mobile terminal such as a mobile phone, people pay more attention to an appearance of the mobile phone, and in particular, to a material of the mobile phone. A plastic housing is generally used for a common mobile phone, for example, Polycarbonate (PC), Acrylonitrile Butadiene Styrene (ABS), or ABS+PC. In recent two years, a mobile phone made of a metal material has gradually drawn people's attention. The mobile phone made of a metal material is fashionable and has a fine texture, a metal housing is more durable than a plastic housing, and heat conductivity of metal is better; a long-time operation does not cause overheating of the mobile phone, which extends a service life of the mobile phone. These advantages interest people in purchase of a mobile phone made of a metal material.

A demand stimulates a market, and in a current industry, a design difficulty of a mobile phone that has a metal-material housing lies in an antenna. For a common antenna, a metal housing shields antenna radiation, and therefore, no signal is available for the mobile phone or a call drop occurs. In the prior art, a solution is removing metal within an antenna area, and the mobile phone uses a regular Inverted F Antenna (IFA)/Planar Inverted F Antenna (PIFA)/Loop antenna as a radiator, instead of using a metal housing as a radiator; therefore, the metal housing within the antenna area of the mobile phone needs to be replaced with a plastic housing. In the technical solution, a plastic housing needs to be used, and in terms of appearance, metal is in the middle and plastic is at the two ends, which has a splicing effect; in addition, there is no sense of an all-metal housing. If a plastic material that has a metal spraying color is used as a replacement, an overall effect of a product is damaged.

In the prior art, there is also a solution in which dual antennas are used for switching to avoid impact on an antenna caused by a metal housing. The antenna is disposed on an external face of the housing of the mobile phone, and when one antenna is held by a hand during a call, a detection apparatus is started, and a signal is switched to the other antenna; therefore, in the antenna solution, multiple antennas need to be used and costs are relatively high. For an Orthogonal Frequency Division Multiplexing (OFDM) multi-carrier aggregation technology in a 4G Long Term Evolution (LTE) system, the antenna switching solution is not applicable, because a signal carrier is equivalent to serial transmission, and an antenna may be switched for serial transmission; but LTE OFDM is equivalent to multi-carrier parallel transmission, and consequently the antenna switching solution is not applicable.

In the prior art, an active-antenna solution may also be used, that is, a metal housing is involved in radiation as a part of an antenna. In a switch switching solution, antenna matching is dynamically switched, to achieve an objective of implementing communication by an antenna in a head-hand mode (that is, a state in which a head and a hand of a person use a mobile phone is simulated). Although the solution in the prior art can be used in an LTE solution, components such as a switch and an adjustable capacitor need to be introduced; therefore, application costs are quite high.

SUMMARY

The present invention is intended to overcome the foregoing disadvantages of the prior art and provides an antenna structure and a mobile terminal device. The antenna structure and the mobile terminal device are characterized by a favorable communication effect and low costs.

According to a first aspect, an antenna structure is provided and includes a housing made of a conducting material, and a feed plate disposed within the housing, where the housing includes a main housing, a first floating object, a second floating object, and an antenna radiator, where the first floating object, the second floating object, and the antenna radiator are all disposed on one side of the main housing, and the first floating object, the second floating object, and the antenna radiator are separated from the main housing by a first isolation slot; the first floating object is disposed on one side of the antenna radiator, and the first floating object is separated from the antenna radiator by a second isolation slot; the second floating object is disposed on the other side of the antenna radiator, the second floating object is separated from the antenna radiator by a third isolation slot, and both the second isolation slot and the third isolation slot are conducted to the first isolation slot; the main housing, the first floating object, the second floating object, and the antenna radiator are connected as a whole by an insulator; and the feed plate is disposed opposite to the main housing, the first floating object, and the antenna radiator at an interval.

With reference to the first aspect, in a first possible implementation manner of the first aspect, one end that is of the antenna radiator and that is close to the first floating object has a feed point, and the feed plate is disposed opposite to the feed point at an interval.

With reference to the foregoing first aspect or the first possible implementation manner of the first aspect, in a second possible implementation manner, the antenna radiator is electrically connected to a grounding terminal of a circuit board.

With reference to the foregoing first aspect, or the first possible implementation manner or the second possible implementation manner of the first aspect, in a third possible implementation manner, the second isolation slot and the third isolation slot are disposed in parallel, and both the second isolation slot and the third isolation slot are perpendicular to the first isolation slot.

With reference to the foregoing first aspect or any implementation manner of the first possible implementation manner to the third possible implementation manner of the first aspect, in a fourth possible implementation manner, the first isolation slot, the second isolation slot, and the third isolation slot are arranged in a "π" shape.

With reference to the foregoing first aspect or any implementation manner of the first possible implementation manner to the fourth possible implementation manner of the first aspect, in a fifth possible implementation manner, the first floating object and the second floating object are respectively disposed on two sides of a lower end of the housing.

According to a second aspect, a mobile terminal device is provided and includes a housing that is made of a conducting material and that may be used as an antenna, where a feed plate is disposed within the housing, the housing includes a main housing, a first floating object, a second floating object, and an antenna radiator, the first floating object, the second floating object, and the antenna radiator are all disposed on one side of the main housing, and the first floating object, the second floating object, and the antenna radiator are separated from the main housing by a first isolation slot; the first floating object is disposed on one side of the antenna radiator, and the first floating object is separated from the antenna radiator by a second isolation slot; the second floating object is disposed on the other side of the antenna radiator, the second floating object is separated from the antenna radiator by a third isolation slot, and both the second isolation slot and the third isolation slot are conducted to the first isolation slot; the main housing, the first floating object, the second floating object, and the antenna radiator are connected as a whole by an insulator; and the feed plate is disposed opposite to the main housing, the first floating object, and the antenna radiator at an interval.

With reference to the second aspect, in a first possible implementation manner of the second aspect, one end that is of the antenna radiator and that is close to the first floating object has a feed point, and the feed plate is disposed opposite to the feed point at an interval.

With reference to the foregoing second aspect or the first possible implementation manner of the second aspect, in a second possible implementation manner, the mobile terminal device further includes a circuit board disposed within the housing, the circuit board has a grounding terminal, and the antenna radiator is electrically connected to the grounding terminal of the circuit board.

With reference to the foregoing second aspect, or the first possible implementation manner or the second possible implementation manner of the second aspect, in a third possible implementation manner, the second isolation slot and the third isolation slot are disposed in parallel, and both the second isolation slot and the third isolation slot are perpendicular to the first isolation slot.

With reference to the foregoing second aspect or any implementation manner of the first possible implementation manner to the third possible implementation manner of the second aspect, in a fourth possible implementation manner, the first isolation slot, the second isolation slot, and the third isolation slot are arranged in a "$\pi$" shape.

With reference to the foregoing second aspect or any implementation manner of the first possible implementation manner to the fourth possible implementation manner of the second aspect, in a fifth possible implementation manner, the first floating object and the second floating object are respectively disposed on two sides of a lower end of the housing.

With reference to the foregoing second aspect or any implementation manner of the first possible implementation manner to the fifth possible implementation manner of the second aspect, in a sixth possible implementation manner, the mobile terminal device is a mobile phone.

The antenna structure and the mobile terminal device of the antenna structure that are provided in the present invention are applicable to a housing that includes a conducting material, which improves user experience. In addition, for a signal-carrier transmission solution, two or more antennas do not need to be disposed for switching, which simplifies the antenna structure and reduces costs; for a multicarrier parallel transmission solution, the antenna structure provided in the present invention may be applied to an antenna application of multicarrier parallel transmission such as 4G LTE, a switch does not need to be disposed for switching matching, and a component such as an adjustable capacitor does not need to be disposed either, which has low application costs and high reliability.

BRIEF DESCRIPTION OF THE DRAWINGS

To describe the technical solutions in the embodiments of the present invention more clearly, the following briefly introduces the accompanying drawings required for describing the embodiments. Apparently, a person of ordinary skill in the art may still derive other drawings from these accompanying drawings without creative efforts.

FIG. 5 shows radiation efficiency of an antenna that is in free space and is in left and right head-hand modes when a mobile terminal device provided in an embodiment of the present invention works in a high frequency band of 1710 MHz to 2170 MHz; and FIG. 6 shows radiation efficiency of an antenna that is in free space and is in left and right head-hand modes when a mobile terminal device provided in an embodiment of the present invention works in a high frequency band of 2520 MHz to 2690 MHz.

DETAILED DESCRIPTION

To make the objectives, technical solutions, and advantages of the present invention clearer and more comprehensible, the following further describes the present invention in detail with reference to the accompanying drawings and embodiments. It should be understood that the specific embodiments described herein are merely used to explain the present invention but are not intended to limit the present invention.

It should be noted that, when it is described that an element is "fastened to" or "disposed on" another element, the element may be directly located on the other element or a center element may coexist. When it is described that an element is "connected to" another element, the element may be directly connected to the other element or a center element may coexist.

It should also be noted that, direction terms such as left, right, upper, and lower in the embodiments are merely relative concepts or a normal usage state of a product is used for reference, but the direction terms should not be considered as a limitation.

Figure 1:
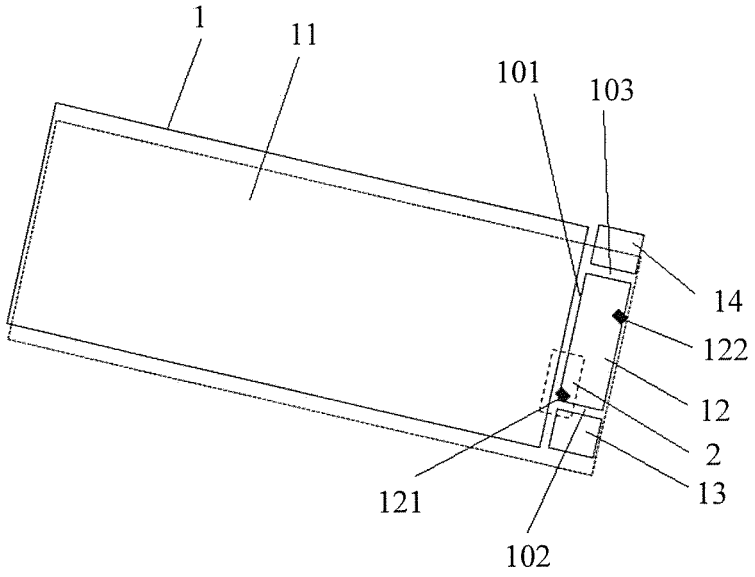
FIG. 1 is a schematic three-dimensional diagram of an antenna structure according to an embodiment of the present invention.
Figure 2:
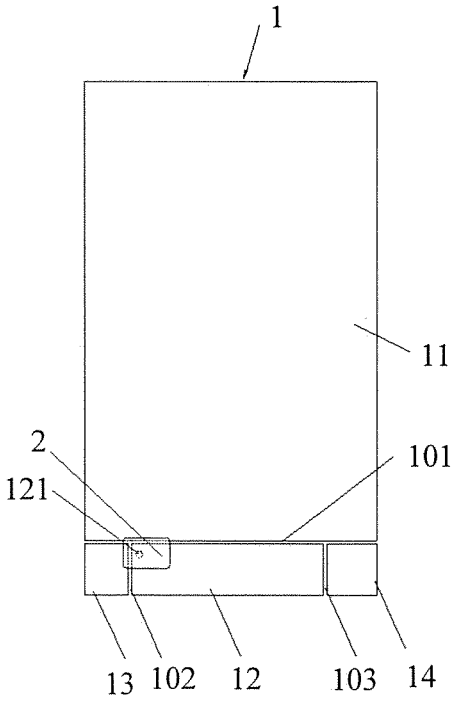
FIG. 2 is a schematic planar diagram of an antenna structure according to an embodiment of the present invention.

As shown in FIG. 1 and FIG. 2, an antenna structure provided in an embodiment of the present invention includes a housing 1 made of a conducting material, and a feed plate 2. The feed plate 2 may be made of a metal plate and may also be referred to as a coupling plate. The housing 1 includes a main housing 11, an antenna radiator 12, a first floating object 13, and a second floating object 14, and all of the main housing 11, the first floating object 13, the second floating object 14, and the antenna radiator 12 may be made of metallic materials. In a specific application, the feed plate 2 may be disposed on an inner side of the housing 1 and is coupled to a metal part of the housing 1. The first floating object 13, the second floating object 14, and the antenna radiator 12 are all disposed on one side of the main housing 11, and the first floating object 13, the second floating object 14, and the antenna radiator 12 are separated from the main housing 11 by a first isolation slot 101; the first floating object 13 is disposed on one side of the antenna radiator 12, and the first floating object 13 is separated from the antenna radiator 12 by a second isolation slot 102; the second floating object 14 is disposed on the other side of the antenna radiator 12, the second floating object 14 is separated from the antenna radiator 12 by a third isolation slot 103, both the second isolation slot 102 and the third isolation slot 103 are conducted to the first isolation slot 101, and the housing 11, the first floating object 13, the second floating object 14, and the antenna radiator 12 are not in contact with each other. The main housing 11, the first floating object 13, the second floating object 14, and the antenna radiator 12 are connected as a whole by an insulator, and the whole may be used as a rear housing of an electronic product, for example, the whole is used as a housing of a product that has an antenna, such as a mobile phone or a tablet computer. In this embodiment, a mobile phone is used as an example to describe beneficial effects of the present invention. In this embodiment, the feed plate 2 is disposed opposite to the main housing 11, the first floating object 13, and the antenna radiator 12 at an interval, and the feed plate 2 is disposed across lower parts of the main housing 11, the first floating object 13, and the antenna radiator 12. In addition, one end that is of the antenna radiator 12 and that is close to the first floating object 13 has a feed point 121, and the feed plate 2 is disposed opposite to the feed point 121 at an interval. The feed point 121 may be connected to a radio frequency component (transceiver) by using a feeder. When a signal is being transmitted, a signal sent by the radio frequency component (transceiver) is coupled to the housing 1 by passing through the feed plate 2 from the feed point 121, and is transmitted. Certainly, the antenna structure may also be set as follows: The feed plate 2 is disposed opposite to the main housing 11, the second floating object 14, and the antenna radiator 12 at an interval, and the feed plate 2 is disposed across lower parts of the main housing 11, the second floating object 14, and the antenna radiator 12. One end that is of the antenna radiator 12 and that is close to the second floating object 14 has a feed point, and the feed plate 2 is disposed opposite to the feed point at an interval.

In a specific application, the main housing 11, the antenna radiator 12, the first floating object 13, and the second floating object 14 may be of a proper shape such as a plate-like shape. By means of stamping, the main housing 11, the antenna radiator 12, the first floating object 13, and the second floating object 14 may be obtained by separately using metal plate materials; or the entire housing 1 may be first formed by means of stamping, and the first isolation slot 101, the second isolation slot 102, and the third isolation slot 103 are then obtained by means of processing on the housing 1, to make the main housing 11, the first floating object 13, the second floating object 14, and the antenna radiator 12 not conducted to each other. In a specific application, the first isolation slot 101, the second isolation slot 102, and the third isolation slot 103 may have various forms, such as a straight line shape, a wavy line shape, or a bent line shape.

As shown in FIG. 1 and FIG. 2, the main housing 11, the first floating object 13, the second floating object 14, and the antenna radiator 12 form, for example, the all-metal housing 1 whose external face is made of a conducting material, and the all-metal housing 1 may also be used as an antenna of the mobile phone. As the antenna of the all-metal housing, integrity of a metal environment of the entire housing needs to be ensured; if a regular antenna is commissioned on the metal housing, an appearance effect of the entire mobile phone is inevitably damaged. In this embodiment of the present invention, a big piece of metal is excited to become an antenna, and impact on the antenna caused by hand holding also needs to be avoided, which is particularly difficult. In this embodiment, the first isolation slot 101, the second isolation slot 102, and the third isolation slot 103 are disposed on the metal housing, coupling feeding is performed by using the feed plate 2 made of a metal plate, and floating processing is also performed on metal (the first floating object 13 and the second floating object 14) respectively on one side of the second isolation slot 102 and the third isolation slot 103. The first isolation slot 101, the second isolation slot 102, and the third isolation slot 103 are disposed, which insulates the antenna from impact caused by a hand or a head of a person; and the feed plate 2 is added to a corresponding gap, to generate a multiple-frequency working mode, so that the antenna can work in an LTE frequency band. The antenna is used to receive and transmit a signal, and signals have different working frequencies and are corresponding to different wavelengths. Only when an electrical length of the antenna is equal to a corresponding wavelength (for example, 0.5 wavelength) is resonance generated, that is, a first mode of the antenna (in this case, because a frequency is relatively low, the first mode is referred to as a low-frequency mode). When N times of the electrical length of the antenna reaches a high-frequency wavelength (for example, 1 wavelength, 1.5 wavelengths, and 2 wavelengths) of the signal, resonance may also be generated, that is, a high-frequency mode in this case. In this embodiment, when the antenna is in the low-frequency mode, because the electrical length of the antenna formed by the feed plate 2 coupled to the antenna radiator 12 precisely reaches a required low-frequency wavelength, resonance may be generated. Similarly, the high-frequency mode is generated by means of frequency multiplication according to a gap length and a higher-order mode of the antenna, and this electrical length also reaches a wavelength of a high frequency signal. More specifically, in this embodiment, generation of the low-frequency working mode of the antenna is excited by an loop antenna formed by the feed plate 2 coupled to the grounding antenna radiator 12, and generation of the high-frequency mode is excited by a gap between the main housing 11 and the antenna radiator 12 and is excited by a higher-order mode of the loop antenna. In this embodiment, a low frequency refers to a range from 824 MHz to 960 MHz, and a high frequency refers to a range from 1710 MHz to 2170 MHz and a range from 2520 MHz to 2690 MHz.

As shown in FIG. 1 and FIG. 2, the antenna structure in this embodiment may be used as a housing of the mobile phone, the floated first floating object 13, and the floated second floating object 14 are reserved on the left and right sides. By using the first floating object 13 and the second floating object 14, in a case in which an antenna body (that is, the main housing 11) is held by a hand, parts and gaps (the first isolation slot 101, the second isolation slot 102, and the third isolation slot 103) that are mainly involved in radiation are all isolated for protection, and are not easily held by the hand simultaneously. An entire structure of a metal housing is set for the housing of the mobile phone, which does not cause adverse impact on a signal of the mobile phone; there are no problems caused by the metal housing, such as no signal and a call drop for the mobile phone, and metal in an antenna area does not need to be removed from the metal housing. In this way, appearance consistency of the housing of the mobile phone is high, heat conductivity of the housing is strong, and a service life is longer. An operating principle of LTE is multicarrier parallel transmission. If multiple antennas are being switched, the multiple antennas can work only at different times, and only serial transmission can be implemented. The antenna structure provided in this embodiment can entirely cover an LTE frequency band, and antennas can work at the same time. For a signal-carrier transmission solution, two or more antennas do not need to be disposed for switching, which simplifies the antenna structure, reduces costs, and reduces space occupied by the antennas. For a multicarrier parallel transmission solution, the antenna structure in this embodiment may be applied to an antenna application of multicarrier parallel transmission such as 4G LTE, to achieve a wideband feature that the antenna covers an LTE frequency band; a switch does not need to be disposed for switching matching, and a component such as an adjustable capacitor does not need to be disposed either, which has low application costs and high reliability.

As shown in FIG. 1 and FIG. 2, widths of the first isolation slot 101, the second isolation slot 102, and the third isolation slot 103 may be set to be quite narrow provided that the adjacent main housing 11, first floating object 13, second floating object 14, and antenna radiator 12 are not in contact with each other. In a specific application, widths of the first isolation slot 101, the second isolation slot 102, and the third isolation slot 103 may be less than 2 mm, or may be even less than 0.5 mm, or 0.1 mm. As a preferred solution, a smallest slot width of the first isolation slot 101 is 1 mm, and slot widths of the second isolation slot 102 and the third isolation slot 103 may be less than 0.5 mm. For example, the slot width of the first isolation slot 101 may be 1 mm, and the slot widths of the second isolation slot 102 and the third isolation slot 103 may be 0.5 mm. Certainly, it may be understood that the slot widths of the first isolation slot 101, the second isolation slot 102, and the third isolation slot 103 may be set to a proper numeric value in another range, for example, the slot widths are greater than 2 mm, which may be specifically set according to an actual case. In terms of appearance, it is difficult to find impact brought by the first isolation slot 101, the second isolation slot 102, and the third isolation slot 103. The first isolation slot 101, the second isolation slot 102, and the third isolation slot 103 may be in a proper shape such as a straight strip shape or an arc shape.

In a specific application, the main housing 11, the antenna radiator 12, the first floating object 13, and the second floating object 14 may be bonded to be the entire housing 1; or an entire insulation liner may be disposed, and the main housing 11, the antenna radiator 12, the first floating object 13, and the second floating object 14 are attached to the insulation liner to form the entire housing 1. The insulation liner may be made of a material such as a plastic cement.

Specifically, as shown in FIG. 1 and FIG. 2, the feed plate 2 may be disposed across a part of the main housing 11, a part of the first floating object 13, a part of the antenna radiator 12, a part of the first isolation slot 101, and apart of the second isolation slot 102. Certainly, the feed plate 2 may be disposed across a whole area of the first floating object 13 that has a relatively small size or/and a whole area of the antenna radiator 12.

Figures 3, 4:
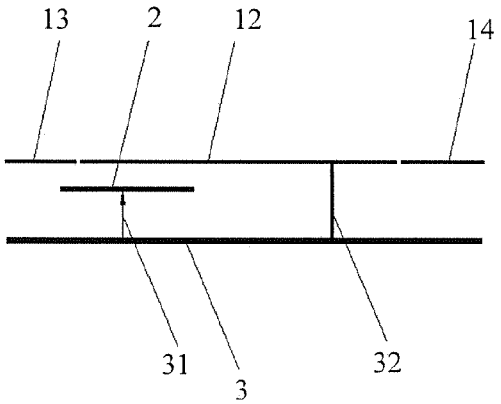
FIG. 3 is a schematic cross-sectional diagram of an antenna structure according to an embodiment of the present invention.
FIG. 4 shows radiation efficiency of an antenna that is in free space and is in left and right head-hand modes when a mobile terminal device provided in an embodiment of the present invention works in a low frequency band of 824 MHz to 960 MHz.

Specifically, as shown in FIG. 2 and FIG. 3, a circuit board 3 may be disposed within the housing 1, where the circuit board 3 may be a main board within the mobile phone. The circuit board 3 has a grounding terminal, the feed point 121 and a grounding point 122 are disposed on the antenna radiator 12, the antenna radiator 12 is electrically connected to the grounding terminal of the circuit board 3, and the antenna radiator 12 is connected to the circuit board 3 by using a grounding connector 32. The feed plate 2 is connected to the circuit board 3 by using a feed connector 31. The first floating object 13 and the second floating object 14 are not grounded.

Specifically, as shown in FIG. 2 and FIG. 3, in this embodiment, the feed plate 2 is disposed across local areas of the main housing 11, the antenna radiator 12, the first floating object 13, the first isolation slot 101, and the second isolation slot 102, to obtain different antenna modes.

Specifically, as shown in FIG. 2 and FIG. 3, the feed plate 2 is coupled to the grounding antenna radiator 12 to form a loop antenna that is used to generate a low-frequency mode of the antenna. Specifically, generation of a high-frequency mode of the antenna is excited by an isolation slot between the main housing 11 and the antenna radiator 12 and is excited by a higher-order mode of the loop antenna. The antenna can work in a corresponding frequency band provided that the antenna has a corresponding electrical length. In this embodiment, because the electrical length of the antenna path formed by the feed plate 2 coupled to the antenna radiator 12 precisely reaches the required low-frequency wavelength, the low-frequency mode of the antenna may be generated. Similarly, the high-frequency mode is generated by means of frequency multiplication according to the gap length and the higher-order mode of the antenna, and antennas may have different electrical lengths, so that the high-frequency mode of the antenna can be obtained.

Specifically, as shown in FIG. 2 and FIG. 3, the second isolation slot 102 and the third isolation slot 103 may be disposed in parallel, and both the second isolation slot 102 and the third isolation slot 103 are perpendicular to the first isolation slot 101. In this way, a better effect can be achieved. Certainly, the second isolation slot 102, the third isolation slot 103, and the first isolation slot 101 may also be arranged in another proper manner. For example, the second isolation slot 102 and the third isolation slot 103 are arranged in a shape of Chinese character "八".

In this embodiment, the first isolation slot 101, the second isolation slot 102, and the third isolation slot 103 are arranged in a "π" shape.

Specifically, as shown in FIG. 2 and FIG. 3, the first floating object 13 and the second floating object 14 are respectively disposed on two sides of a lower end of the housing 1, which may effectively prevent the first floating object 13 and the second floating object 14 from being held by a hand of a user when the first floating object 13 and the second floating object 14 are being used, and in particular, when the mobile phone is on a call.

As shown in FIG. 1 and FIG. 2, an embodiment of the present invention further provides a mobile terminal device, where the mobile terminal device may be a mobile phone, a tablet computer, a navigation device, or the like. In this embodiment, a mobile phone is used as an example to describe beneficial effects of the present invention. The foregoing mobile terminal device includes the foregoing housing 1 that is made of a conducting material such as metal and that may be used as an antenna, where a feed plate 2 is disposed within the housing 1, an entire metal rear housing of the mobile phone may be used as a part of the antenna, and coupling feeding is performed by using the feed plate 2. The housing 1 includes a main housing 11, a first floating object 13, a second floating object 14, and an antenna radiator 12, the first floating object 13, the second floating object 14, and the antenna radiator 12 are all disposed on one side of the main housing 11, and the first floating object 13, the second floating object 14, and the antenna radiator 12 are separated from the main housing 11 by a first isolation slot 101; all of the main housing 11, the first floating object 13, the second floating object 14, and the antenna radiator 12 may be made of metallic materials. The first floating object 13 is disposed on one side of the antenna radiator 12, and the first floating object 13 is separated from the antenna radiator 12 by a second isolation slot 102; the second floating object 14 is disposed on the other side of the antenna radiator 12, the second floating object 14 is separated from the antenna radiator 12 by a third isolation slot 103, and both the second isolation slot 102 and the third isolation slot 103 are conducted to the first isolation slot 101; the main housing 11, the first floating object 13, the second floating object 14, and the antenna radiator 12 are connected as a whole by an insulator; and the feed plate 2 is disposed opposite to the main housing 11, the first floating object 13, and the antenna radiator 12 at an interval, and the feed plate 2 is disposed across lower parts of the main housing 11, the first floating object 13, and the antenna radiator 12. In addition, one end that is of the antenna radiator 12 and that is close to the first floating object 13 has a feed point 121, and the feed plate 2 is disposed opposite to the feed point 121 at an interval. The feed point 121 may be connected to a radio frequency component (transceiver) by using a feeder. When a signal is being transmitted, a signal sent by the radio frequency component (transceiver) is coupled to the housing 1 by passing through the feed plate 2 from the feed point 121, and is transmitted. Certainly, the mobile terminal device may also be set as follows: The feed plate 2 is disposed opposite to the main housing 11, the second floating object 14, and the antenna radiator 12 at an interval, and the feed plate 2 is disposed across lower parts of the main housing 11, the second floating object 14, and the antenna radiator 12. One end that is of the antenna radiator 12 and that is close to the second floating object 14 has a feed point, and the feed plate 2 is disposed opposite to the feed point at an interval.

Specifically, the main housing 11, the antenna radiator 12, the first floating object 13, and the second floating object 14 may be of a proper shape such as a plate-like shape. By means of stamping, the main housing 11, the antenna radiator 12, the first floating object 13, and the second floating object 14 may be obtained by separately using metal plate materials; or the entire housing 1 may be first formed by means of stamping, and the first isolation slot 101, the second isolation slot 102, and the third isolation slot 103 are then obtained by means of processing on the housing 1, to make the main housing 11, the first floating object 13, the second floating object 14, and the antenna radiator 12 not conducted to each other.

In a specific application, the feed plate 2 may be disposed on an inner side of the housing 1 and is coupled to a metal part of the housing 1. When a signal is being transmitted, a signal sent by the radio frequency component is coupled to the housing 1 bypassing through the feed plate 2 from the feed point, and is transmitted.

In a specific application, the first isolation slot 101, the second isolation slot 102, and the third isolation slot 103 may have various forms, such as a straight line shape, a wavy line shape, or a bent line shape.

As shown in FIG. 1 and FIG. 2, the main housing 11, the first floating object 13, the second floating object 14, and the antenna radiator 12 form the housing 1 that has an all-metal external face and that may also be used as an antenna of the mobile phone. As the antenna of the all-metal housing, integrity of a metal environment of the entire housing needs to be ensured; if a regular antenna is commissioned on the metal housing, an appearance effect of the entire mobile phone is inevitably damaged. In this embodiment of the present invention, a big piece of metal is excited to become an antenna, and impact on the antenna caused by hand holding also needs to be avoided, which is particularly difficult. In this embodiment, the first isolation slot 101, the second isolation slot 102, and the third isolation slot 103 are disposed on the metal housing, coupling feeding is performed by using the feed plate 2 made of a metal plate, and floating processing is also performed on metal (the first floating object 13 and the second floating object 14) respectively on one side of the second isolation slot 102 and the third isolation slot 103. The first isolation slot 101, the second isolation slot 102, and the third isolation slot 103 are disposed, which insulates the antenna from impact caused by a hand or a head of a person; and the feed plate 2 is added to a corresponding gap, to generate a multiple-frequency working mode, so that the antenna can work in an LTE frequency band. The antenna is used to receive and transmit a signal, and signals have different working frequencies and are corresponding to different wavelengths. Only when an electrical length of the antenna is equal to a corresponding wavelength (for example, 0.5 wavelength) is resonance generated, that is, a first mode of the antenna (in this case, because a frequency is relatively low, the first mode is referred to as a low-frequency mode). When N times of the electrical length of the antenna reaches a high-frequency wavelength (for example, 1 wavelength, 1.5 wavelengths, and 2 wavelengths) of the signal, resonance may also be generated, that is, a high-frequency mode in this case. In this embodiment, when the antenna is in the low-frequency mode, because the electrical length of the antenna path formed by the feed plate 2 coupled to the antenna radiator 12 precisely reaches a required low-frequency wavelength, resonance may be generated. Similarly, the high-frequency mode is generated by means of frequency multiplication according to a gap length and a higher-order mode of the antenna, and this electrical length also reaches a wavelength of a high frequency signal. More specifically, in this embodiment, generation of the low-frequency working mode of the antenna is excited by an loop antenna formed by the feed plate 2 coupled to the grounding antenna radiator 12, and generation of the high-frequency mode is excited by a gap between the main housing 11 and the antenna radiator 12 and is excited by a higher-order mode of the loop antenna. In this embodiment, a low frequency refers to a range from 824

MHz to 960 MHz, and a high frequency refers to a range from 1710 MHz to 2170 MHz and a range from 2520 MHz to 2690 MHz.

As shown in FIG. 1 and FIG. 2, the floated first floating object 13 and the floated second floating object 14 are reserved on the left and right sides of a rearing housing of the mobile phone in this embodiment. By using the first floating object 13 and the second floating object 14, in a case in which an antenna body (that is, the main housing 11) is held by a hand, parts and gaps that are mainly involved in radiation are all isolated for protection, and are not held by the hand. An entire structure of a metal housing is set for the housing of the mobile phone, which does not cause adverse impact on a signal of the mobile phone; there are no problems caused by the metal housing, such as no signal and a call drop for the mobile phone, and metal in an antenna area does not need to be removed from the metal housing. In this way, appearance consistency of the housing of the mobile phone is high, heat conductivity of the housing is strong, and a service life is longer. An operating principle of LTE is multicarrier parallel transmission. If multiple antennas are being switched, the multiple antennas can work only at different times, and only serial transmission can be implemented. The antenna structure of the mobile terminal device provided in this embodiment can entirely cover an LTE frequency band, and antennas can work at the same time. For a signal-carrier transmission solution, two or more antennas do not need to be disposed for switching, which simplifies the antenna structure, reduces costs, and reduces space occupied by the antennas. For a multicarrier parallel transmission solution, the antenna structure in this embodiment may be applied to an antenna application of multicarrier parallel transmission such as 4G LTE, a switch does not need to be disposed for switching matching, and a component such as an adjustable capacitor does not need to be disposed either, which has low application costs and high reliability. The antenna can work in a corresponding frequency band provided that the antenna has a corresponding electrical length. In this embodiment, because the electrical length of the antenna path formed by the feed plate 2 coupled to the antenna radiator 12 precisely reaches the required low-frequency wavelength, the low-frequency mode of the antenna may be generated. Similarly, the high-frequency mode is generated by means of frequency multiplication according to the gap length and the higher-order mode of the antenna, and antennas may have different electrical lengths, so that the high-frequency mode of the antenna can be obtained.

As shown in FIG. 1 and FIG. 2, widths of the first isolation slot 101, the second isolation slot 102, and the third isolation slot 103 may be set to be quite narrow provided that the adjacent main housing 11, first floating object 13, second floating object 14, and antenna radiator 12 are not in contact with each other. In a specific application, widths of the first isolation slot 101, the second isolation slot 102, and the third isolation slot 103 may be less than 2 mm, or may be even less than 0.5 mm, or 0.1 mm. As a preferred solution, a smallest slot width of the first isolation slot 101 is 1 mm, and slot widths of the second isolation slot 102 and the third isolation slot 103 may be less than 0.5 mm. For example, the slot width of the first isolation slot 101 may be 1 mm, and the slot widths of the second isolation slot 102 and the third isolation slot 103 may be 0.5 mm. Certainly, it may be understood that the slot widths of the first isolation slot 101, the second isolation slot 102, and the third isolation slot 103 may be set to a proper numeric value in another range, for example, the slot widths are greater than 2 mm, which may be specifically set according to an actual case. In terms of appearance, it is difficult to find impact brought by the first isolation slot 101, the second isolation slot 102, and the third isolation slot 103.

As shown in FIG. 1 and FIG. 2, in a specific application, the main housing 11, the antenna radiator 12, the first floating object 13, and the second floating object 14 may be bonded to be the entire housing 1; or an entire insulation liner may be disposed, and the main housing 11, the antenna radiator 12, the first floating object 13, and the second floating object 14 are attached to the insulation liner to form the entire housing 1. The insulation liner may be made of a material such as a plastic cement.

As shown in FIG. 1 to FIG. 3, specifically, the mobile terminal device may further include a circuit board 3 that is disposed within the housing 1, where the circuit board 3 has a grounding terminal. The antenna radiator 12 is connected to the circuit board 3 by using a grounding connector 32, and the grounding connector 32 is connected to a grounding point 122 on the antenna radiator 12 and the grounding terminal of the circuit board 3. The feed plate 2 is connected to the circuit board 3 by using a feed connector 31, and the feed plate 2 is disposed opposite to the feed point 121 at an interval. The first floating object 13 and the second floating object 14 are not grounded.

Specifically, the second isolation slot 102 and the third isolation slot 103 are disposed in parallel, and both the second isolation slot 102 and the third isolation slot 103 are perpendicular to the first isolation slot 101.

Specifically, as shown in FIG. 2 and FIG. 3, the first floating object 13 and the second floating object 14 are respectively disposed on two sides of a lower end of the housing 1, which may effectively prevent the first floating object 13 and the second floating object 14 from being held by a hand of a user when the first floating object 13 and the second floating object 14 are being used, and in particular, when the mobile phone is on a call.

According to the mobile terminal device provided in this embodiment of the present invention, a housing 1 of the mobile terminal device may be used as a part of an antenna structure, isolation slots are disposed near a feed point 121 of an antenna, the isolation slots are arranged in a "π" shape, and the antenna structure generates one low-frequency mode and three high-frequency modes, which can cover low frequencies ranging from 824 MHz to 960 MHz, and high frequencies ranging from 1710 MHz to 2170 MHz and 2520 MHz to 2690 MHz. The antenna structure can not only be used in 2G and 3G communication applications, but can also be applicable to a 4G LTE application, which can ensure an all-metal housing feature of a mobile phone, and achieve higher head-hand efficiency and a wideband feature that the antenna covers an LTE frequency band in addition to improving user experience. FIG. 4 shows radiation efficiency of an antenna that is in free space and is in left and right head-hand modes when a mobile terminal device provided in an embodiment works in a low frequency band; FIG. 5 and FIG. 6 show radiation efficiency of an antenna in free space and is in left and right head-hand modes in a high frequency band. The antenna has advantages such as simple structure and low costs.

The antenna structure and the mobile terminal device of the antenna structure that are provided in the embodiments of present invention ensure an all-metal housing feature of the mobile terminal device, and achieve a wideband feature that an antenna covers an LTE frequency band in addition to improving user experience. In addition, the antenna structure and the mobile terminal device of the antenna structure have a small energy loss and high head-hand radiation efficiency in a case in which a mobile phone held by a hand of a user is close to a head, thereby improving communication quality of the mobile phone, extending a service life of a battery of the mobile phone, and the antenna structure is simple and costs are low.

The foregoing descriptions are merely exemplary embodiments of the present invention, but are not intended to limit the present invention. Any modification, equivalent replacement, and improvement made without departing from the spirit and principle of the present invention shall fall within the protection scope of the present invention.

What is claimed is:

1. An antenna structure, comprising:

a housing made of a conducting material, wherein the housing comprises, a main housing, and a first floating object, a second floating object and an antenna radiator all disposed on one side of the main housing, and wherein the first floating object, the second floating object, and the antenna radiator are separated from the main housing by a first isolation slot, the first floating object is disposed on one side of the antenna radiator, and the first floating object is separated from the antenna radiator by a second isolation slot, the second floating object is disposed on the other side of the antenna radiator, the second floating object is separated from the antenna radiator by a third isolation slot, and both the second isolation slot and the third isolation slot are conducted to the first isolation slot, and the main housing, the first floating object, the second floating object, and the antenna radiator are connected as a whole by an insulator; and a feed plate disposed within the housing, wherein the feed plate is disposed opposite to the main housing, the first floating object, and the antenna radiator at an interval, wherein the first floating object is not electrically connected to the antenna radiator and is not electrically connected to the feed plate; and wherein the second floating object is not electrically connected to the antenna radiator and is not electrically connected to the feed plate.

2. The antenna structure according to claim 1, wherein one end of the antenna radiator positioned close to the first floating object has a feed point, and the feed plate is disposed opposite to the feed point at an interval.

3. The antenna structure according to claim 1, wherein the antenna radiator is electrically connected to a grounding terminal of a circuit board.

4. The antenna structure according to claim 1, wherein the second isolation slot and the third isolation slot are disposed in parallel, and both the second isolation slot and the third isolation slot are perpendicular to the first isolation slot.

5. The antenna structure according to claim 1, wherein the first isolation slot, the second isolation slot, and the third isolation slot are arranged in a "π" shape.

6. The antenna structure according to claim 1, wherein the first floating object and the second floating object are respectively disposed on two sides of a lower end of the housing.

7. A mobile terminal device, comprising:

a housing made of a conducting material and used as an antenna, the housing comprising, a main housing, and a first floating object, a second floating object, and an antenna radiator all disposed on one side of the main housing, and wherein the first floating object, the second floating object, and the antenna radiator are separated from the main housing by a first isolation slot, the first floating object is disposed on one side of the antenna radiator, and the first floating object is separated from the antenna radiator by a second isolation slot, the second floating object is disposed on the other side of the antenna radiator, the second floating object is separated from the antenna radiator by a third isolation slot, and both the second isolation slot and the third isolation slot are conducted to the first isolation slot, the main housing, the first floating object, the second floating object, and the antenna radiator are connected as a whole by an insulator, and a feed plate disposed within the housing, wherein the feed plate is disposed opposite to the main housing, the first floating object, and the antenna radiator at an interval, wherein the first floating object is not electrically connected to the antenna radiator and is not electrically connected to the feed plate; and wherein the second floating object is not electrically connected to the antenna radiator and is not electrically connected to the feed plate.

8. The mobile terminal device according to claim 7, wherein one end of the antenna radiator positioned close to the first floating object has a feed point, and the feed plate is disposed opposite to the feed point at an interval.

9. The mobile terminal device according to claim 7, wherein the mobile terminal device further comprises a circuit board disposed within the housing, the circuit board has a grounding terminal, and the antenna radiator is electrically connected to the grounding terminal of the circuit board.

10. The mobile terminal device according to claim 7, wherein the second isolation slot and the third isolation slot are disposed in parallel, and both the second isolation slot and the third isolation slot are perpendicular to the first isolation slot.

11. The mobile terminal device according to claim 7, wherein the first isolation slot, the second isolation slot, and the third isolation slot are arranged in a "π" shape.

12. The mobile terminal device according to claim 7, wherein the first floating object and the second floating object are respectively disposed on two sides of a lower end of the housing.

13. The mobile terminal device according to claim 7, wherein the mobile terminal device is a mobile phone.

* * * * *